United States Patent [19]

Loftus

[11] 4,312,637

[45] Jan. 26, 1982

[54] SLAG OUTLET FOR A GASIFICATION GENERATOR

[75] Inventor: Jordan Loftus, Houston, Tex.

[73] Assignee: Texaco Inc., White Plains, N.Y.

[21] Appl. No.: 162,286

[22] Filed: Jun. 23, 1980

[51] Int. Cl.[3] ..... C10J 3/68

[52] U.S. Cl. ..... 48/77; 48/DIG. 2; 110/266; 110/165 R

[58] Field of Search ..... 110/266, 165 R; 266/236; 48/DIG. 2, 76, 77, 63, 62 R, 64

[56] References Cited

U.S. PATENT DOCUMENTS

| | | | |
|---|---|---|---|
| 1,228,769 | 6/1917 | Grindle | 110/266 |
| 2,716,598 | 8/1955 | Moses | 48/DIG. 2 |
| 2,801,158 | 7/1957 | Grossman et al. | 48/DIG. 2 |
| 3,018,174 | 1/1962 | Steever | 48/63 |
| 3,357,383 | 12/1967 | Golovanov et al. | 110/266 |
| 4,119,411 | 10/1978 | Anderson et al. | 110/266 |
| 4,218,423 | 8/1980 | Robin et al. | 48/DIG. 2 |

FOREIGN PATENT DOCUMENTS

| | | | |
|---|---|---|---|
| 675113 | 4/1939 | Fed. Rep. of Germany | 110/266 |

*Primary Examiner*—S. Leon Bashore
*Assistant Examiner*—Michael L. Goldman
*Attorney, Agent, or Firm*—Carl G. Ries; Robert A. Kulason; Henry C. Dearborn

[57] ABSTRACT

Structure for slag removal from a gasification generator. It employs a duct through the bottom that carries through it products of the combustion which is being carried out in the generator. The dimensions are such that the slag which adheres to the walls remains liquid and drips from the bottom edges. The duct is enlarged by at least one step with the length and width of it related to the upper portion of the duct so that the bottom edges of the step are above a diagonal of the upper portion extended.

8 Claims, 2 Drawing Figures

SLAG OUTLET FOR A GASIFICATION GENERATOR

BACKGROUND OF THE INVENTION

1. Field of the Invention

This invention concerns gasification of finely divided solids, in general. More specifically, it relates to structure in combination with a gasification generator that deals with the separation of non-gasifiable components from the fuel for gasification.

2. Description of the Prior Art

While the problem of dealing with liquid slag that results from gasification type operations where powdered fuel is employed, have been in existence for a long time and furnace structures of various sorts have been proposed, the problem still exists. Thus, there is an old U.S. Pat. No. 1,228,769 to A. J. Grindle, issued June 5, 1917, and there is a more recent U.S. Pat. No. 3,357,383 to N. V. Golovanov et al, issued Dec. 12, 1967. However, while the Grindle patent indicates a furnace structure with apertures in the floor thereof for having liquid slag flow through, it seems obvious that these passages would be subject to build up of solidified slag in accordance with the difficulties which have been found to exist with high pressure gasification generators. On the other hand, the Golovanov et al patent is clearly a specially constructed furnace which is not applicable to the situation that is of concern in this invention.

Consequently, it is an object of this invention to provide improved structure for a gasification generator that develops liquid slag. Such slag needs to be separated from the gasifiable components.

SUMMARY OF THE INVENTION

Briefly, the invention is in combination with a gasification generator wherein the products of combustion include a significant amount of non-gasifiable component which forms a liquid slag. It relates to means for transferring said slag to a following stage with minimum heat loss and maximum conversion of solids to gaseous product. It comprises a vertically oriented duct in the bottom of said generator for carrying said products of combustion through. The said duct comprises an upper cylindrical passageway, and a plurality of coaxial cylindrical extensions beneath said upper passageway. The said extensions have larger diameters increasing in steps from said upper passageway, and the lengths of said extensions are such that the bottom edge of each is above a diagonal extended from said upper passageway.

Once more briefly, the invention is in combination with a gasification generator for finely divided coal. The combination comprises a right circular cylindrical duct in the bottom of said generator for permitting gasification products to flow therethrough, including liquid slag entrained therewith. The said duct comprises an upper portion and a plurality of larger diameter lower portions joined stepwise by horizontal planar surfaces. The said upper portion has dimensions such that said slag remains liquid, and said lower portions have lengths such that the bottom edges are above an upper portion diagonal extended.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENT

In connection with a gasification generator where products of the combustion that is carried out in the generator include significant amounts of non-gasifiable components, there is the necessity for separating such components from the gaseous products. At the same time, it is desirable that the heat losses from the burner or reactor chamber should be minimized in order to maximize potential energy available in the products, and to maximize conversion of solid fuel to gaseous products. Such conditions are met by providing a small exit from the burner or reactor chamber, i.e. the generator. Such exit goes to the next stage which may be a separator for an adiabatic separation, or a heat recovery unit. In either case, the small exit or restriction is such that it has hot temperatures upstream and relatively cold downstream where the non-gasifiable material leaves the generator as a liquid. And, solidification of the molten liquid (slag) which is developed from the non-gasifiable material, must be avoided. Otherwise, build-up of solid material will cause bridging and subsequent closure of the restriction and that will result in failure of the entire operation.

In the past, the restriction from a gasification generator has been a duct of constant cross-section that is insulated to minimize radial heat losses. An example of such restriction is a vertical cylindrical duct. A portion of the liquid slag tends to impinge on the walls of the duct and run down to the bottommost point where it drips off. Such drip point receives energy by radiation from the hot fluids and walls above it, and the molten liquid loses energy by radiation to the cold fluids and surfaces below. Also, hot gaseous products that flow through the restriction supply energy by convection and by radiation to the walls of the restriction.

It will be clear to one skilled in the art that the temperature of the drip point must exceed the minimum free flowing temperature of the slag. However, past experience has shown that it is difficult to prevent build-up of solids and thus a tendency to cause closing of the restriction.

This invention provides for structure which causes the drip point of a restriction to be moved up, relatively, into the restriction. The result enhances radiant heating from above and diminishes radiant cooling to the colder fluids and surfaces below.

Figure 1:
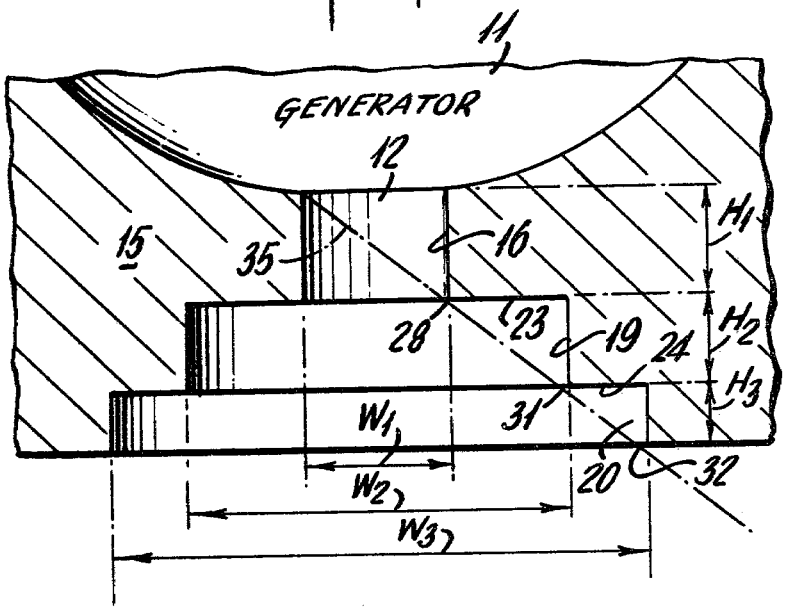
FIG. 1 is a schematic cross-sectional showing of the bottom structure for a generator used in coal gasification.

Thus, with reference to FIG. 1 of the drawings, there is illustrated a bottom portion of a generator 11 which is schematically indicated in cross-section. The floor of the generator 11 is, of course, made with a refractory material, and there is a duct 12 that extends down through a bottom wall 15.

The duct 12 has an upper portion 16 that is preferably a right circular cylindrical configuration. It extends from the inside surface of the bottom wall 15 of generator 11, and permits gasification products from the generator 11 to flow therethrough. Such products include liquid slag which may be entrained therewith. Also, there are a plurality of larger diameter lower portions 19 and 20 that are part of the duct 12. These lower portions are joined stepwise by horizontal planar surfaces 23 and 24, respectively.

The action, indicated above, creates a drip point 28 at the bottom of the upper part 16 of the duct 12. And, an important feature of this invention concerns the dimensions of the lower portions 19 and 20 relative to the upper portion 16 of the duct 12. These dimensions are such that the bottom edges, i.e. those indicated by points 31 and 32 on the cross-sectional showing, are located above a diagonal (dashed line 35) of the upper portion 16, extended. It is this feature which prevents any direct impingement on the walls of lower portions 19 and 20 by liquid slag which may be entrained in the flowing gaseous products of combustion from the generator.

Another way of defining the structural relationship described above, is arrived at by triangulation of the dimensions involved. Thus, in terms of the dimensions that are indicated in FIG. 1, the widths, i.e. diameters of the upper and lower portions of the duct 12 are indicated by the captions $W_1$, $W_2$, and $W_3$, for the widths of the upper and lower portions 16, 19 and 20, respectively. Similarly, the vertical dimensions of the upper and lower portions of the duct 12 are indicated by the captions $H_1$, $H_2$, and $H_3$, representing the respective lengths of portions 16, 19 and 20.

It will be understood that in order to have the relationship indicated above, i.e. with respect to the diagonal of the upper portion 16, the relationship must follow the following mathematical expression:

$$W_2 > W_1(1+2H_2/H_1) \quad (1)$$

It may be noted that this prevents the occurrence of lower drip points.

In the foregoing expression (1), it will be understood that $W_1$ is the constant cross-section of the upper portion 16 of the duct 12, and $W_2$ is the diameter of the next adjoining wider portion 19, while the length of each is represented by the $H_1$ and the $H_2$ captions, respectively. It will also be clear that if more steps of wider cross-section portions of the duct are employed, the expression which represents the relationship for any given number of such steps may be expressed in the following form:

$$W_J > W_1(1+2H_J/H_1+2H_{J-1}/H_1 \ldots +2H_2/H_1) \quad (2)$$

Figure 2:
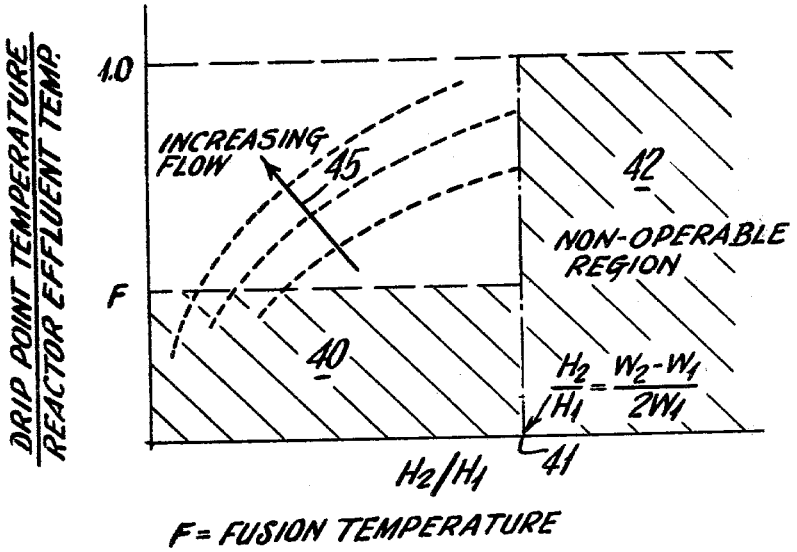
FIG. 2 is a graph with captions illustrating the principles of the invention.

An example of employing structure according to this invention in connection with the separation of molten slag from reactor gases in a powdered coal gasifier, is illustrated in FIG. 2. The conditions shown by the graph illustrated in FIG. 2 indicate the ratio of drip point temperature to the reactor effluent temperature, as the ordinate values on the graph. And, the ratio of the height $H_2$ to the height $H_1$ is represented on the abscissa of the graph.

It will be understood that at some ratio less than one, i.e. that indicated at point "F" on the ordinate of the graph, the slag will no longer remain liquid so that ratios below that point will result in non-operable conditions as indicated by a reference numeral 40. Also, the limiting ratio of the lengths of the second portion $H_2$ to that of the first portion $H_1$ is indicated on the graph at a point 41 on the abscissa. Thus, ratios greater than the difference between the diameter of the second portion $W_2$ and the first portion $W_1$, divided by twice the diameter of the first portion $W_1$, will result in non-operable conditions as indicated by a reference numeral 42.

In addition, it will be understood that the rate of flow of the effluent from the generator will affect conditions. This is indicated by an arrow 45 that has the caption "Increasing Flow" applied thereto.

It may be noted that in actual operation of a generator according to this invention, the amount of gaseous products that are passed through the restriction (duct 12) may be controlled to prevent closure when low grade fuels are being processed. In other words, low grade fuels will produce more slag and therefore more heat will be required to maintain the molten state thereof.

While a particular embodiment of the invention has been described in considerable detail in accordance with the applicable statutes, this is not to be taken as in any way limiting the invention, but merely as being descriptive thereof.

I claim:

1. In combination with a gasification generator wherein the products of combustion within said generator include a significant amount of non-gasifiable component which forms a liquid slag, said generator having a bottom wall including means for transferring said slag to a following stage with minimum heat loss and maximum conversion of solids to gaseous product, comprising a duct in said bottom wall for carrying said products of combustion therethrough, said duct having an upper portion with constant diameter cross-section extending downward through said bottom wall and dimensions such that said liquid slag may run down the walls thereof and drip from the lowest point while maintaining the temperature of said slag above the minimum free flowing temperature, and said duct having at least one lower portion with larger diameter cross-section extending downward from said drip point and having the bottom edge thereof above an extended diagonal of said upper portion which diagonal connects the point where said duct contacts the bottom of the generator and said drip point.

2. In combination with a gasification generator according to claim 1, wherein said larger diameter cross-section is greater than said constant diameter cross-section in accordance with the relationship $$W_2 > W_1(1+2H_2/H_1)$$

wherein:

$W_1$ = said constant diameter cross-section;

$W_2$ = said larger diameter cross-section;

$H_1$ = the length of said constant diameter cross-section; and $H_2$ = the length of said larger diameter cross-section.

3. In combination with a gasification generator according to claim 2, wherein said duct dimensions also comprise a plurality of said lower portions with larger diameter cross-sections in steps in accordance with the relationship $$W_J > W_1(1+2H_J/H_1+2H_{J-1}/H_1 \ldots +2H_2/H_1)$$

wherein J is the number of duct portions.

4. In combination with a gasification generator for finely divided solids, the combination comprising a duct in the bottom of said generator for permitting gasification products to flow therethrough, said gasification products including liquid slag entrained therewith, said duct comprising an upper cylindrical portion having dimensions such that said slag remains liquid on the walls thereof and drips from the bottom edges, and at least one lower cylindrical portion having a larger diameter, said lower portion having dimensions such that the bottom edges thereof are above an extended diagonal of said upper portion which diagonal connects points where said upper portion contacts the bottom of the generator and said lower portion.

5. The invention according to claim 4, wherein said duct also comprises a planar surface joining said upper and lower cylindrical portions.

6. The invention according to claim 5, wherein said duct is vertically oriented, and said planar surface is horizontally oriented.

7. In combination with a gasification generator wherein the products of combustion include a significant amount of non-gasifiable component which forms a liquid slag, means for transferring said slag to a following stage with minimum heat loss and maximum conversion of solids to gaseous product, comprising a vertically oriented duct in the bottom of said generator for carrying said products of combustion therethrough, said duct comprising an upper cylindrical passageway, and a plurality of coaxial cylindrical extensions beneath said upper passageway, said extensions having larger diameters and increasing in diameter in steps from said upper passageway, and the lengths of said extensions being such that the bottom edge of each is above an extended diagonal of said upper passageway which diagonal connects points where said upper passageway contacts the bottom of the generator and said extensions.

8. In combination with a gasification generator for finely divided coal, the combination comprising a right circular cylindrical duct in the bottom of said generator for permitting gasification products to flow therethrough including liquid slag entrained therewith, said duct comprising an upper portion and a plurality of larger diameter lower portions joined stepwise by horizontal planar surfaces, said upper portion having dimensions such that said slag remains liquid, and said lower portions having lengths such that the bottom edges thereof are above an extended diagonal of said upper portion which diagonal connects points where said upper portion contacts the bottom of the generator and said lower portions.

* * * * *